US006386105B1

(12) United States Patent
Stahl

(10) Patent No.: US 6,386,105 B1
(45) **Date of Patent: *May 14, 2002**

(54) METHOD AND APPARATUS FOR CLEANING INK FOUNTAIN IN ROTARY PRINTING MACHINE

(75) Inventor: Dietmar Stahl, Obertshausen (DE)

(73) Assignee: MAN Roland Druckmaschinen AG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/535,326

(22) Filed: Mar. 27, 2000

(30) Foreign Application Priority Data

Mar. 27, 1999 (DE) ..... 199 14 099

(51) Int. Cl.[7] ..... B41F 35/04
(52) U.S. Cl. ..... 101/423; 101/424
(58) Field of Search ..... 101/423, 424, 101/425, 483, 350.1; 15/256.5, 256.51; 399/345, 350, 357

(56) References Cited

U.S. PATENT DOCUMENTS 5,327,830 A * 7/1994 Gelinas et al. ..... 101/363
5,440,982 A * 8/1995 Meadows et al. ..... 101/363
5,809,887 A * 9/1998 Blackwell et al. ..... 101/350.1
5,974,970 A * 11/1999 Izume ..... 101/350.1
6,047,640 A * 4/2000 Murakawa ..... 101/425
6,053,102 A * 4/2000 Schönberger ..... 101/350.1

FOREIGN PATENT DOCUMENTS

JP A2-58951 3/1997
JP 09057951 A * 3/1997

* cited by examiner

*Primary Examiner*—John S. Hilten
*Assistant Examiner*—Anthony H. Nguyen
(74) *Attorney, Agent, or Firm*—Leydig, Voit & Mayer, Ltd.

(57) ABSTRACT

An apparatus and method for removing and cleaning ink from an ink fountain in a rotary printing press. The ink fountain includes an ink fountain container having a fountain roll disposed adjacent an open side thereof. The apparatus includes a scraping device for forcing ink from the container in the direction of the inking roll, and a metering device disposed between the container and fountain roll which is movable to an open position to form a gap between the fountain roll and container through which ink forced by the scraping device is directed into an underlying catching trough. The container further includes a doctor blade positionable into adjacent relation to the fountain roll for removing ink from the fountain roll during a cleaning operation and directing the removed ink into the catching trough so as to preclude contamination of the downstream roll train of the inking unit.

10 Claims, 3 Drawing Sheets

METHOD AND APPARATUS FOR CLEANING INK FOUNTAIN IN ROTARY PRINTING MACHINE

FIELD OF THE INVENTION

The present invention relates to an apparatus and method for removing ink or similar printing media from a media containing container of a rotary printing press, and more particularly, to a method and apparatus for removing ink from an ink fountain having an open-sided ink container closed by an associated ink fountain roll.

BACKGROUND OF THE INVENTION

A prior method and apparatus for removing ink from an ink fountain is disclosed in Japanese patent publication JP-A2 9-57951 dated Mar. 4, 1997. This reference shows an ink fountain having a scraping device which can be pivoted relative to the ink fountain for doctoring the ink out of the ink fountain. The scraping device is moved downwardly during cleaning of the ink fountain in order to scrape off ink from the bottom of the ink fountain, utilizing a wiping blade action, which shifts the ink in the direction of an ink fountain roll. Ink adhering to the rotating ink fountain roll is transferred to the inking roll chain of the inking unit and is subsequently scraped off by a doctor device having a collecting container arranged at the end of the inking roll train. The apparatus includes the scraping apparatus which slides over the bottom surface of the ink fountain to scrape off ink from the surface and shift it in the direction of the ink fountain roll, a pivoting apparatus arranged above the ink fountain for pivoting the scraping apparatus to and fro in the direction of the ink fountain, a cleaning apparatus for removing the ink adhering to the rolls of the ink roll chain, and a device for catching the cleaning liquid or ink that is removed. The apparatus is not only complicated, but requires that the removed ink be conveyed away via the entire roll train of the inking unit, which is time consuming and which can contaminate the roll train.

OBJECTS AND SUMMARY OF THE INVENTION

It is an object of the present invention to provide an apparatus and method for removing ink or similar printing media from a container in a rotary printing machine, which is relatively simple in design and operation and which eliminates the need for the removed ink to be transferred through the entire ink roll train of the printing unit.

Another object is to provide an ink fountain for a rotary printing machine having an open sided end container with an ink fountain roll at an end thereof, in which the ink expelled during cleaning is directed to the fountain roll, but is not conveyed to or through the roll train of the inking unit.

A further object is to provide an apparatus and method of the above kind in which the path of movement of the removed ink or similar printing media during a cleaning operation is significantly shortened so as to shorten the cleaning time.

Still another object is to provide an apparatus and method of the foregoing type in which the ink fountain has selectively movable means for creating a gap between the ink fountain container and fountain roll for the discharge of ink removed during a cleaning operation prior to transfer through the ink roll chain.

Yet another object is to provide an apparatus and method of the foregoing type that is useful for removing quick drying inks and similar printing media. A related object is to provide such an apparatus and method which effectively prevents ink from drying on the ink fountain roll and which reduces the need for, or amounts of, washing agents necessary for cleaning the ink fountain roll.

Other objects and advantages of the invention will become apparent upon reading the following detailed description and upon reference to the drawings, in which:

Figure 1:
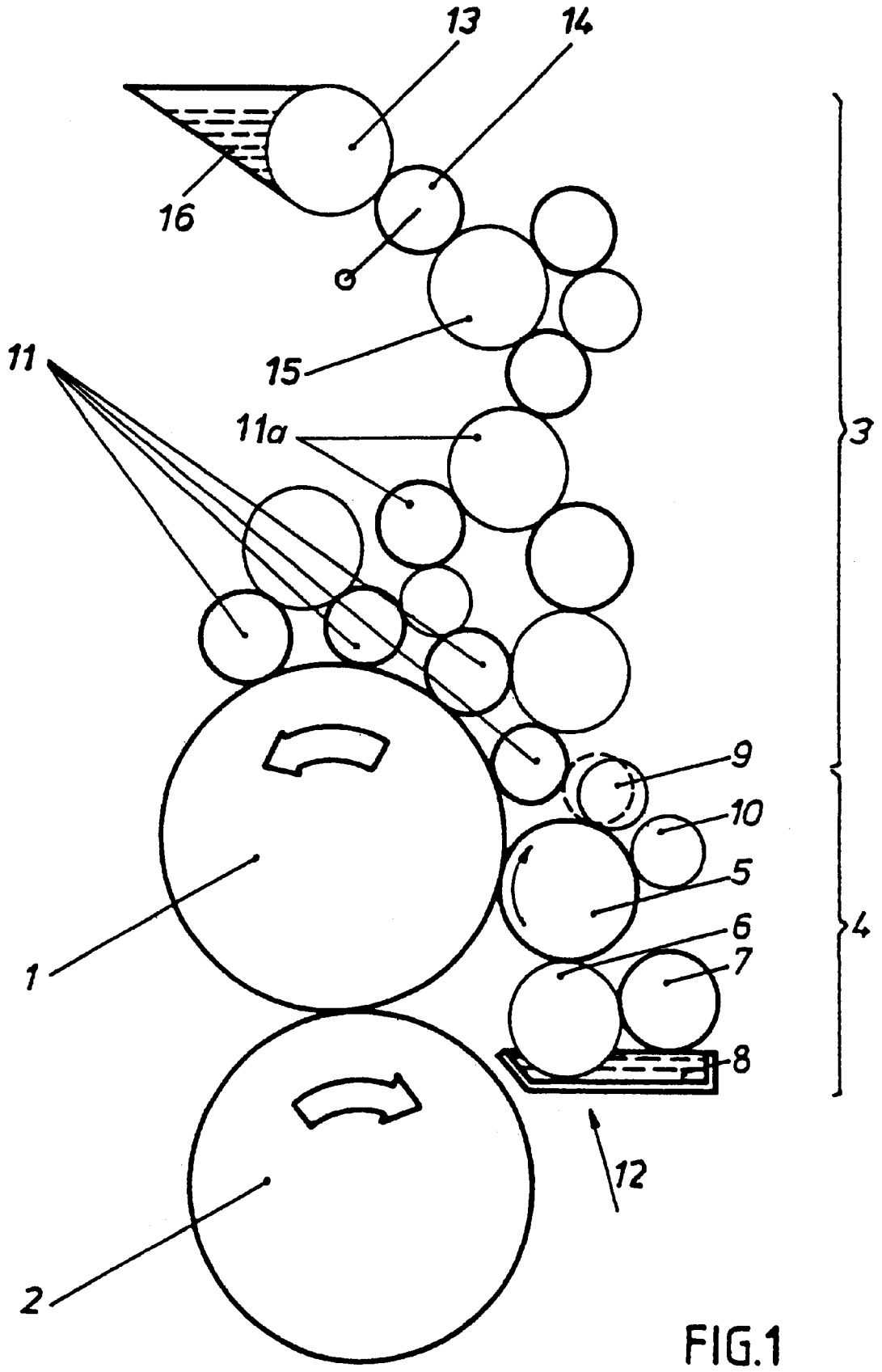
FIG. 1 is a diagrammatic depiction of a rotary printing machine having an ink fountain in accordance with the present invention.
Figure 2:
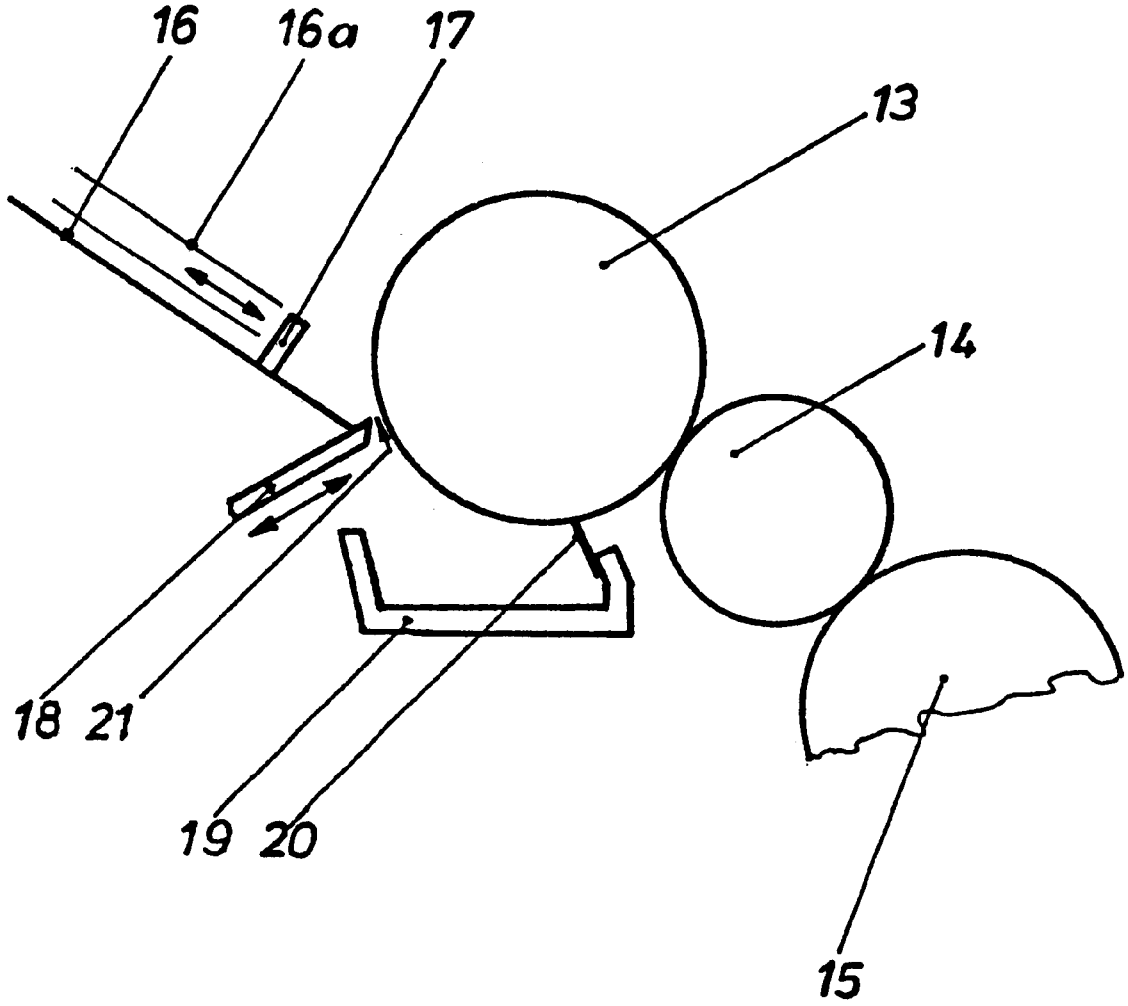
FIG. 2 is an enlarged size elevation view of the ink fountain included in the printing machine depicted in FIG. 1.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIG. 1 of the drawings, there is a shown an illustrative offset printing machine having a rotatable plate cylinder 1 which carries a printing form and is disposed in adjacent relation to a blanket cylinder 2. Associated with the plate cylinder 1 is a dampening unit 4 and an inking unit 3.

For supplying a dampening medium to the plate cylinder 1, the dampening unit 4 includes a dampening applicator roller 5 disposed in contacting relation to the plate cylinder 1 at a point which precedes the inking unit 3 as seen in the direction of rotation of the plate cylinder 1. For supplying dampening medium to the applicator roller 5, the dampening unit includes a dampening feed device 12 which includes a dampening medium container 8, a dampening duct roll 6 in contacting relation with the dampening applicator roller 5 and disposed within the dampening medium container 8, and a dampening medium roller 7 in contacting relation to the duct roller 6 for creating a thin dampening medium film on the duct roller 6 for transfer to the dampening medium applicator roller 5. The dampening applicator roll 5 in this case has an adjacent rider roll 10 and a bridging roll 9, the latter being movable as indicated between solid and dotted lines in FIG. 1.

For supplying ink to the plate cylinder 1, the inking unit 3 comprises a plurality of ink applicator rolls 11 connected to an ink roll train comprising ink feeding rolls 11*a*, which in turn communicate with a transfer roll 15. An ink fountain is provided which includes an ink or similar printing medium container 16, which is open at one side and which has an associated fountain roll 13 closing an end thereof. The container 16 in this case has a bottom wall that tapers downwardly to the horizontal toward the fountain roll 13. Disposed between the fountain roll 13 and the transfer roll 15 is a vibrator roll 14 adapted for swinging to and fro between the ink fountain roll 13 and the transfer roll 15.

While the fountain roll 13 preferably is an ink fountain roll and the container 16 which is open at one side is preferably an ink fountain container, it will be understood that the invention will be applicable for use with other liquid printing mediums, such as varnish and water based inks and varnishes. For purposes herein, printing media is intended to encompass all such printing mediums.

In accordance with the invention, the ink fountain has a cleaning media apparatus which is effective for quickly cleaning the printing media container by scraping the ink from the container downwardly in the direction of the fountain roll while eliminating the need for the removed ink to be transferred through the entire roll chain of the inking unit. To this end, the ink fountain container has a scraping device 17 in contact with the bottom surface of the container which is movable toward and away from the fountain roll 13 in the direction of the double arrow. The scraping device 17 preferably is supported for movement by linear guides 16*a* mounted on opposite sides of the container 16. It will be understood by one skilled in the art that the scraping device 17 may be moved along such linear guides by manual or automated means. It can be seen that as the scraper 16 is moved in a direction downwardly along the container it will scrape and force accumulated ink in the direction of the fountain roll 13.

In carrying out the invention, a metering device 18 is provided at the bottom of the container adjacent the ink fountain roll which can be moved from a position adjacent the fountain roll to a position away from the fountain roll, in the direction of the double arrow, for providing an opening between the container 16 and fountain roll 13 through which printing media moved toward the fountain roll 13 by the scraper may be directed. It will be understood that the scraping device may comprise a plurality of slides, or take the form of a single gate-type slide, which can be moved toward and away from the fountain roll 13.

For providing a receptacle for printing and media discharge from the container under the action of the scraper 17, a catching trough 19 is disposed beneath the metering device 18 and fountain roll 13. The trough 19 in this case has a doctor blade 20 supported at one end at a negative angle to the fountain roll, in other words, extending in an upward and rearward direction relative to the fountain roll 13 and container 16.

It will be seen that in order to remove ink or similar printing media from the container, such as at the end of printing or during an ink change operation, the printing media is pushed forwardly and downwardly in a direction toward the fountain roll 13 by means of the scraper device 17 and is expelled from the container 16 through the opening defined by the metering device 18, when in a retracted or open position. It will be appreciated that the metering device 18 can be selectively positioned within a desired range, but is preferably open completely so that there is a relatively large gap 21 between the fountain roll 13 and the metering device 18 during cleaning operations. The size of the gap an be selectively determined, that is to say larger or smaller, depending upon the viscosity of the ink or other printing media and the desired throughput of the printing media from the gap 21. As the ink is directed through the gap 21, residual ink adhering to the periphery of the roll 13 is wiped off by means of the doctor blade 20 and similarly directed into the catching trough 19. The doctor blade 20 preferably is selectively brought into contact with the fountain roll 13 during a cleaning operation. When the doctor blade is not needed, it may be moved to a position spaced away from the fountain roll. It will be understood that the trough 19 and doctor blade 20 may be simultaneously moved into operative position for a cleaning operation, with the blade in contacting relation to the ink fountain roll, or alternatively, the doctor blade may be selectively moved relative to the trough and fountain roll for contacting engagement with the fountain roll during a cleaning operation. To further prevent contamination of the ink train rolls downstream of the fountain roll, during a cleaning operation, the vibrator roll 14 preferably is moved to a position spaced away from the fountain roll 13. The vibrator roll preferably is moved into contact with the adjacent transfer roll 15.

Figure 3:
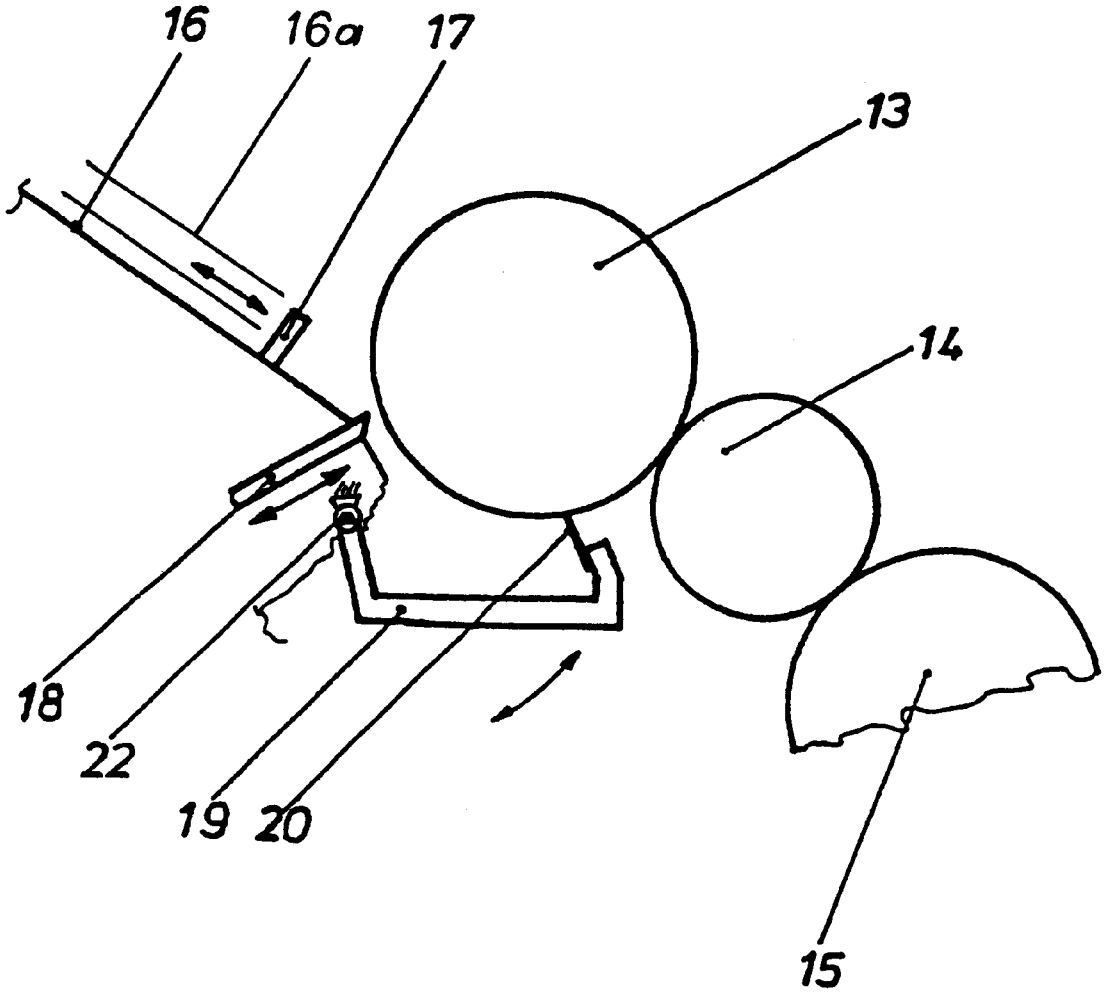
FIG. 3 is an enlarged side elevation view of an alternative embodiment of ink fountain according to the invention.

The catching trough 19 may be an integrated part of the container 16 such as being connected to a lower part of the container 16. The catching trough 19 and doctor 20 may be mounted for movement relative to the container and roll for enabling selective contact of the doctor blade 20 with respect to the fountain roll 13. Alternatively, the catching trough 19 and doctor blade 20 may be removed from the container, or the catching trough 19 maybe mounted for pivotal movement with respect to the container, about a pivot axis 22, as depicted in FIG. 3. In the FIG. 3 embodiment, during a cleaning operation the trough 19 is pivoted into operative position, with the doctor blade engaging the fountain roll 13, thereby enabling the metering device 18 to be moved to an open position for the cleaning cycle. Following the cleaning cycle, the metering device 18 is moved to a closed position enabling the trough to be pivoted downwardly so as to separate the doctor blade 20 from the fountain roll.

It will be appreciated by one skilled in the art that the fountain roll 13 can be cleaned by means of an ink unit washing apparatus after most of the ink or other printing media has been removed from the ink fountain. For this purpose, the vibrating roll 14 may be oscillated to and fro between the fountain roll 13 and the transfer roll 15. Alternatively, the vibrator roll can be positioned in continuous contact between the transfer roll 15 and the fountain roll 13. Prior to oscillation of the vibrating roll 14, an appropriate spraying device may direct a washing agent to the roll train of the inking unit. After the washing agent has been directed onto the roll train, the mixture of the washing agent and ink can be wiped off the last roll in the inking unit 3 by means of an appropriate doctor device which can be brought into and out of contact with the last roll of the inking unit, for directing the washing liquid and ink into an appropriate underlying trough.

From the foregoing, it can be seen that the ink fountain cleaning apparatus is relatively simple in design and operation, and while ink is scraped from the ink fountain container and moved in a downward direction toward the ink fountain roll, the apparatus eliminates the need for the removed ink to the transferred through the entire roll chain of the printing unit. As a result, the cleaning operation can be more quickly carried out, thereby shortening the cleaning cycle time so as to be useful for removing even quick drying inks and similar printing media from the ink fountain. By virtue of the more efficient cleaning and removal of printing media from the ink fountain, without contamination of downstream roll train, the apparatus eliminates the need for or at least reduces the quantity of washing agents necessary for cleaning the ink fountain and roll train following a printing operation.

What is claimed:

1. A printing machine comprising a plate cylinder, a printing media supply unit for supplying printing media to the plate cylinder, said printing media supply unit including a printing media container which is open at one side and a fountain roll disposed adjacent the open side of said container, a roll train comprising a plurality of rolls communicating between said fountain roll and said plate cylinder for supplying printing media to said plate cylinder during a printing operation, a metering device disposed between said container and fountain roll, said metering device being movable between a metering position in close adjacent relation to said fountain roll for metering ink to said fountain roll and in turn said roll train and plate cylinder during a printing operation and an open cleaning position spaced from said fountain roll to form a container emptying gap between said fountain roll and container to facilitate emptying of printing media in said container through said gap during a cleaning operation, a scraping device movable back and forth in said container during a cleaning operation for forcing printing media in said container toward said fountain roll and through said container emptying gap during a cleaning operation when said metering device is in said open cleaning position, a catching trough disposed below said metering device for receiving and containing printing media forced through said container emptying gap by said scraping device, and a doctor blade movable between an open position removed from said fountain during a printing operation to a cleaning position closely adjacent said fountain roll during a cleaning operation when said metering device is in said open position for removing printing media from the fountain roll during a cleaning operation and directing it into said catching trough in order to prevent the transfer of removed printing media to said roll train and said plate cylinder during said cleaning operation.

2. The printing machine of claim 1 in which said container has linear guides for guiding linear movement of said scraping device.

3. The printing machine of claim 2 in which said container has a bottom wall angled downwardly relative to the horizontal in the direction of said fountain roll.

4. The printing machine of claim 1 in which said catching trough has a doctor blade in adjacent relation to said fountain roll during a cleaning operation and for removing printing media from the fountain roll and directing said removed printing media into said catching trough.

5. The printing machine of claim 1 which said doctor blade is disposed at an angle in an upstream direction towards said printing media container.

6. The apparatus of claim 1 further including an ink fountain which includes said container and fountain roll.

7. The printing machine of claim 4 in which said catching trough is coupled to said container.

8. The printing machine of claim 4 in which said catching trough is removably coupled to said container.

9. The apparatus of claim 4 in which said catching trough is pivotally connected to said container.

10. A method of removing printing media from a container of a printing media supply of a rotary printing press, the container being opened to one side and having a fountain roll disposed adjacent the open side of the container in a rotary printing press having a roll train for communicating printing media from said fountain roll to a plate cylinder during a printing operation comprising the steps of providing the container with a metering device that is movable between a closed position adjacent said fountain roll for metering ink to said fountain roll during a printing operation and an open cleaning position spaced from said fountain roll for forming a container emptying gap between the container and fountain roll through which cleaning media may be more quickly dispensed during a cleaning operation, moving said metering device to said open position prior to a cleaning operation, moving a scraper along the bottom of the container to force printing media in the direction of said fountain roll and through said container emptying gap during a cleaning operation when said metering device is in said open position for direction into an underlying catching trough, providing a doctor blade that is movable between an open position removed from said fountain roll during a printing operation and a closed position in close proximity to said fountain roll, and moving said doctor blade to said closed position during a cleaning operation for wiping off printing media thereon and directing such wiped off printing media into said underlying trough.

* * * * *